US008808473B2

(12) United States Patent
Hirata et al.

(10) Patent No.: US 8,808,473 B2
(45) Date of Patent: Aug. 19, 2014

(54) AUSTENITIC HEAT RESISTANT ALLOY

(75) Inventors: Hiroyuki Hirata, Neyagawa (JP); Hirokazu Okada, Kobe (JP); Hiroyuki Semba, Sanda (JP); Kazuhiro Ogawa, Nishinomiya (JP); Atsuro Iseda, Kobe (JP); Mitsuru Yoshizawa, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/472,640

(22) Filed: May 16, 2012

(65) Prior Publication Data

US 2012/0288400 A1 Nov. 15, 2012

Related U.S. Application Data

(63) Continuation of application No. PCT/JP2010/071954, filed on Dec. 8, 2010.

(30) Foreign Application Priority Data

Dec. 10, 2009 (JP) ..... 2009-279982

(51) Int. Cl.
*C22C 19/05* (2006.01)

(52) U.S. Cl.
USPC ..... 148/427; 148/428; 148/442; 420/433; 420/448; 420/449; 420/450; 420/452; 420/454; 420/485; 420/586; 420/586.1

(58) Field of Classification Search
USPC ..... 148/427, 428, 442; 420/433, 448, 449, 420/450, 452, 454, 485, 586, 586.1
See application file for complete search history.

(56) References Cited

U.S. PATENT DOCUMENTS

| | | | | |
|---|---|---|---|---|
| 6,258,317 | B1 | 7/2001 | Smith et al. | |
| 6,458,318 | B1 * | 10/2002 | Nishiyama et al. | 420/448 |
| 6,702,906 | B2 * | 3/2004 | Ogawa et al. | 148/428 |
| 8,293,169 | B2 * | 10/2012 | Semba et al. | 420/450 |

(Continued)

FOREIGN PATENT DOCUMENTS

| | | |
|---|---|---|
| CN | 1451778 | 10/2003 |
| CN | 1977058 | 6/2007 |

(Continued)

OTHER PUBLICATIONS

Edited by Japan Welding Society: Welding/Joining Handbook 2nd Edition, 2003 Maruzen, p. 948-950.

*Primary Examiner* — Sikyin Ip
(74) *Attorney, Agent, or Firm* — Clark & Brody

(57) ABSTRACT

An austenitic heat resistant alloy includes, by mass percent, C: 0.15% or less, Si: 2% or less, Mn: 3% or less, Ni: 40 to 60%, Co: 10.14 to 25%, Cr: 15% or more and less than 28%, either one or both of Mo: 12% or less and W: less than 0.05%, the total content thereof being 0.1 to 12%, Nd: 0.001 to 0.1%, B: 0.0005 to 0.006%, N: 0.03% or less, O: 0.03% or less, at least one selected from Al: 1.36% or less, Ti: 3% or less, and Nb: 3% or less, and the balance being Fe and impurities. The contents of P and S in the impurities are P: 0.03% or less and S: 0.01% or less. The alloy satisfies $1 \leq 4 \times Al + 2 \times Ti + Nb \leq 12$ and $P + 0.2 \times Cr \times B \leq 0.035$, where an element in the Formulas represents the content by mass percent.

2 Claims, 1 Drawing Sheet

(56) References Cited

U.S. PATENT DOCUMENTS

| | | | | |
|---|---|---|---|---|
| 8,313,591 | B2 * | 11/2012 | Hirata et al. | 148/442 |
| 2006/0051234 | A1 | 3/2006 | Pike | |
| 2007/0181225 | A1 * | 8/2007 | Igarashi et al. | 148/410 |
| 2011/0088819 | A1 * | 4/2011 | Semba et al. | 148/707 |

FOREIGN PATENT DOCUMENTS

| | | |
|---|---|---|
| EP | 0 260 600 | 3/1988 |
| EP | 0 381 121 | 8/1990 |
| EP | 1 065 290 | 1/2001 |
| EP | 1 777 313 | 4/2007 |
| JP | 51-084726 | 7/1976 |
| JP | 51-084727 | 7/1976 |
| JP | 60-100640 | 6/1985 |
| JP | 60-110856 | 6/1985 |
| JP | 63-076840 | 4/1988 |
| JP | 64-055352 | 3/1989 |
| JP | 02-107736 | 4/1990 |
| JP | 02-200756 | 8/1990 |
| JP | 07-150277 | 6/1995 |
| JP | 07-216511 | 8/1995 |
| JP | 07-331390 | 12/1995 |
| JP | 08-127848 | 5/1996 |
| JP | 08-218140 | 8/1996 |
| JP | 09-157779 | 6/1997 |
| JP | 10-096038 | 4/1998 |
| JP | 2001-107196 | 4/2001 |
| JP | 2002-518599 | 6/2002 |
| WO | 02/40728 | 5/2002 |
| WO | 2006/003954 | 1/2006 |
| WO | 2009/154161 | 12/2009 |
| WO | 2010/038826 | 4/2010 |

* cited by examiner

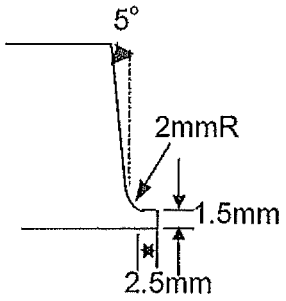
5°
2mmR
1.5mm
2.5mm

AUSTENITIC HEAT RESISTANT ALLOY

The disclosure of International Application No. PCT/JP2010/071954, filed Dec. 8, 2010 including specification, drawings and claims is incorporated herein by reference in its entirety.

TECHNICAL FIELD

The present invention relates to an austenitic heat resistant alloy. More particularly, the invention relates to an austenitic heat resistant alloy that is excellent in both of weld crack resistance and toughness of a heat affected zone (HAZ) after long-term use, and further excellent in creep strength at high temperatures, and is used for high-temperature equipment such as power generation boilers and chemical industry plants.

BACKGROUND ART

In recent years, brand-new ultra super critical boilers, which use increased steam temperature and pressure to enhance the boiler efficiency, have been installed worldwide. Specifically, it is also planned that the steam temperature, which has been about 600° C. so far, is to be raised to 650° C. or higher, or further to 700° C. or higher. This is based on the fact that energy saving, effective use of resources, and reduction in $CO_2$ gas emissions for environmental preservation have been issues to be solved and an important industrial policy. This is also because, to a power generation boiler, a reactor for chemical industry, and the like in which a fossil fuel is burnt, an ultra super critical boiler and a reactor that offer high efficiency are advantageous.

The high-temperature and pressure of steam raises the actual operation temperature of high-temperature equipment consisting of thick plates and forgings, which are used as boiler superheater tubes and tubes of reactor for chemical industry, and heat resistant pressurized parts, to 700° C. or higher. Therefore, the material that is used in such a harsh environment for a long period of time is required to have not only excellent high-temperature strength and high-temperature corrosion resistance but also excellent long-term stability of metal micro-structure and creep characteristics.

Accordingly, Patent Documents 1 to 3 disclose heat resistant alloys that contain an increased amount of Cr and Ni and further contain one or more kinds of Mo and W to improve the creep rupture strength, which is one kind of the high-temperature strength.

Further, to meet the increasingly stringent requirement for high-temperature strength characteristics, especially the requirement for creep rupture strength, Patent Documents 4 to 7 disclose heat resistant alloys that contain, by mass percent, 28 to 38% of Cr and 35 to 60% of Ni and utilize the precipitation of an $\alpha$-Cr phase of body-centered cubic structure consisting mainly of Cr to further improve the creep rupture strength.

On the other hand, Patent Documents 8 to 11 disclose Ni-based alloys that contain Mo and/or W to achieve solid-solution strengthening, and also contain Al and Ti and utilize the precipitation strengthening of a $\gamma'$ phase, which is an intermetallic compound, specifically $Ni_3(Al, Ti)$ to be allowed being used in the above-described harsh high-temperature environment.

Also, Patent Document 12 discloses a high-Ni austenitic heat resistant alloy in which the addition range of Al and Ti is controlled, and a $\gamma'$ phase is precipitated to improve the creep strength.

Further, Patent Documents 13 to 16 disclose Ni-based alloys that contain Co in addition to Cr and Mo to further increase the strength.

LIST OF PRIOR ART DOCUMENT(S)

Patent Literature

[Patent Document 1] JP60-100640A
[Patent Document 2] JP64-55352A
[Patent Document 3] JP2-200756A
[Patent Document 4] JP7-216511A
[Patent Document 5] JP7-331390A
[Patent Document 6] JP8-127848A
[Patent Document 7] JP8-218140A
[Patent Document 8] JP51-84726A
[Patent Document 9] JP51-84727A
[Patent Document 10] JP7-150277A
[Patent Document 11] JP2002-518599A
[Patent Document 12] JP9-157779A
[Patent Document 13] JP60-110856A
[Patent Document 14] JP2-107736A
[Patent Document 15] JP63-76840A
[Patent Document 16] JP2001-107196A

Non-Patent Literature

[Non Patent Document 1] Edited by Japan Welding Society: Welding/Joining Handbook, 2nd edition (2003, Maruzen), pp. 948-950

DISCLOSURE OF THE INVENTION

Problems to be Solved by the Invention

In Patent Documents 1 to 14, although the austenitic heat resistant alloys in which the creep rupture strength is improved have been disclosed, studies have not been conducted from the viewpoint of "weldability" at the time when the alloys are assembled as a structural member.

The austenitic heat resistant alloy is generally assembled into various structural members by welding, and is used at high temperatures. For example, in Non Patent Document 1 (Edited by Japan Welding Society: Welding/Joining Handbook, 2nd edition (2003, Maruzen), pp. 948-950), it has been reported that if the amount of alloying element increases, during the welding work, there arises a problem that cracking occurs in a weld heat affected zone (hereinafter, referred to as a HAZ), especially in a HAZ adjacent to the fusion boundary.

Concerning the cause for occurrence of cracking in the HAZ adjacent to the fusion boundary, various opinions such that the cracking is caused by a precipitated phase at grain boundaries or caused by segregation at grain boundaries have been proposed; however, the mechanism thereof has not been clarified completely.

Thus, in the austenitic heat resistant alloy, although the cracking in the HAZ at the welding time has been recognized as a problem for a long time, the measures against this problem, especially measures in terms of material, have not been established because the mechanism thereof has not been clarified completely.

In particular, in the austenitic heat resistant alloys having been proposed in large numbers, with the increase in strength, many kinds of alloying elements have been contained, and additionally, in the high-efficiency boiler having been planned recently, it has been studied that the austenitic heat resistant alloy is used in a location stringent in terms of dynamics, such as a thick-wall member represented by a main steam pipe and an intricately shaped member represented by a waterwall tube, so that there is a tendency for the problem of cracking occurring in the HAZ to surface further.

Further, in the case where an application to such a thick-wall and large-diameter member is thought, even the HAZ is required to have a sufficient low-temperature toughness at the machine stopping time. The toughness of HAZ also decreases with the increase in the amount of alloying element, and in particular, for the material to which Al, Ti and Nb are added, the toughness of HAZ decreases remarkably after long-term use.

On the other hand, in aforementioned Patent Document 15, although the cracking in HAZ has been mentioned, the application to a location stringent in terms of dynamics has remained uneasy, as described above. Further, although the toughness of weld metal has been mentioned, the toughness of HAZ has not been considered. Therefore, a problem of HAZ performance especially at the time when the alloy is applied to a thick-wall member such as a main steam pipe remains.

Also, in Patent Document 16, although the reheat cracking occurring in weld metal and the toughness of weld metal have been mentioned, the HAZ performance has not been referred to at all.

The present invention has been made in view of the above situation, and accordingly an objective thereof is to provide an austenitic heat resistant alloy that is excellent in both of weld crack resistance and toughness of HAZ, and further excellent in creep strength at high temperatures, and is used for equipment used at high temperatures.

"Excellent in weld crack resistance" specifically means that the alloy is excellent in resistance to liquation cracking in the HAZ.

Means for Solving the Problems

To solve the above-described problems, the present inventors made detailed examination of the causes for cracking and decrease in toughness occurring in HAZ.

As the result, it was found that especially in an alloy containing B as an essential element to ensure creep strength as in the present invention, in order to prevent HAZ cracking at the welding time and to reduce the decrease in toughness of HAZ after long-term use, (1) To control the contents of P and B to a predetermined range according to the content of Cr, and (2) To contain Nd that is effective in removing harm of P are effective.

Further, the present inventors made detailed examination of the cracked portion produced in HAZ during welding. As the result, the following items [1] to [3] were confirmed.

[1] Cracking occurred at the crystal grain boundaries of HAZ close to the fusion boundary.

[2] A fusion trace was noticed on a crack fracture surface produced in HAZ, and concentration of P and B, especially remarkable concentration of B, was noticed on the fracture surface. Because of the above-described fact, hereinafter, the cracking of HAZ occurring during welding is sometimes referred to as "liquation cracking of HAZ".

[3] The degree of influence of B on the liquation cracking of HAZ was affected by the amount of Cr contained in the alloy, and as the Cr content increased, the adverse influence of B became more remarkable.

On the other hand, the present inventors made detailed examination of the toughness of HAZ portion after long-term aging. As the result, the following items [4] to [7] were confirmed.

[4] The decrease in toughness was remarkable in a HAZ close to the fusion boundary.

[5] On the fracture surface after impact test, many portions fractured at the grain boundaries were observed.

[6] On the grain boundary fracture surface, the concentration of P and B was noticed. In a HAZ in which the decrease in toughness was remarkable, the concentration of P was remarkable. In contrast, in a HAZ in which the decrease in toughness was slow, the concentration of B was remarkable.

[7] In the case where the contents of P and B were approximately equal, although the degree of decrease in toughness after long-term heating was slight, as the Cr content decreased, the degree of decrease in toughness tended to increase.

From the above-described items [1] to [7], it was revealed that the cracking occurring in HAZ during welding and the decrease in toughness after long-term use are closely connected with P and B existing at the grain boundaries. In addition, it was suggested that Cr exerts an indirect influence on the cracking and the decrease in toughness.

The present inventors presumed that the above-described phenomenon occurs by means of the following mechanism.

P and B are segregated at the grain boundaries of HAZ in the vicinity of the fusion boundary by the heat cycle during welding. Both of P and B segregated at the grain boundaries are elements that decrease the fusing point of grain boundary. Therefore, the grain boundaries melt locally during welding, the fusion location being opened by welding heat stress, and the so-called "liquation cracking" occurs.

On the other hand, P and B segregated at the grain boundaries also segregate at the grain boundaries during long-term use. P decreases the sticking force of grain boundaries, whereas B inversely strengthens the grain boundaries. Therefore, P exerts an adverse influence on the toughness, whereas B inversely reduces the decrease in toughness.

Concerning the reason why the degree of influence of P and B on the liquation cracking and toughness of HAZ is affected by the amount of Cr contained in the alloy, the present inventors presumed as described below.

As described above, both of P and B are elements that segregate easily at the grain boundaries. In the case where the Cr content is high, Cr having a strong affinity for P exists in large amounts in the grains, so that the segregation of P at the grain boundaries in the welding heat cycle and during the subsequent use at high temperatures is restrained. As a result, B segregates at the segregation site at which a vacancy is created. Therefore, in the HAZ of a material containing more Cr, the influence of B on the liquation cracking is strong, and the decrease in toughness after long-term heating is reduced.

Based on the above-described presumption, the present inventors further conducted various studies.

As the result, the present inventors found that in preventing the liquation cracking of HAZ and reducing the decrease in toughness, it is effective that the contents of P and B are defined so as to be in the range that satisfies a predetermined relational expression according to the content of Cr.

In addition, the present inventors found that it is effective to eliminate the adverse influence of P on both of the liquation cracking and the toughness of HAZ, and as measures therefor, Nd, which specifically has a strong affinity for P and forms a stable compound having a high fusing point, must be contained as an essential element. This effect of eliminating the adverse influence of P is noticed for Nd only, and even if an element referred collectively to as a "REM", such as La, and Ce, other than Nd is added, this effect is not noticed.

Further, the present inventors found that a proper amount of one or more kinds of elements of Al, Ti and Nb is contained, and an intermetallic compound combining with Ni is finely precipitated in grains, whereby the excellent creep strength at high temperatures and the excellent toughness after long-term heating can be ensured.

Also, the present inventors found that especially in an austenitic heat resistant alloy containing, by mass percent, Cr: 15% or more and less than 28%, Ni: 40 to 60%, and B: 0.0005 to 0.006%, Nd: 0.001 to 0.1% is contained, and parameter F1 represented by Formula (1) is 1 or more and 12 or less, and parameter F2 represented by Formula (2) is 0.035 or less, whereby the excellent creep strength and creep ductility can be ensured at high temperatures, and moreover both of the occurrence of liquation cracking of HAZ during welding and the decrease in toughness after long-term use, which are caused by the segregation of P and B at the grain boundaries, can be reduced.

$$F1=4\times Al+2\times Ti+Nb \quad (1)$$

$$F2=P+0.2\times Cr\times B \quad (2)$$

in which, a symbol of an element in the Formulas represents the content by mass percent of the element.

The present invention has been completed based on the above findings, and the gists thereof are austenitic heat resistant alloys described in items (1) and (2).

(1) An austenitic heat resistant alloy consisting of, by mass percent, C: 0.15% or less, Si: 2% or less, Mn: 3% or less, Ni: 40 to 60%, Co: 0.03 to 25%, Cr: 15% or more and less than 28%, either one or both of Mo: 12% or less and W: less than 4%, the total content thereof being 0.1 to 12%, Nd: 0.001 to 0.1%, B: 0.0005 to 0.006%, N: 0.03% or less, O: 0.03% or less, at least one selected from Al: 3% or less, Ti: 3% or less, and Nb: 3% or less, the balance being Fe and impurities, and the contents of P and S in the impurities being P: 0.03% or less and S: 0.01% or less, wherein parameter F1 represented by Formula (1) is 1 or more and 12 or less, and parameter F2 represented by Formula (2) is 0.035 or less.

$$F1=4\times Al+2\times Ti+Nb \quad (1)$$

$$F2=P+0.2\times Cr\times B \quad (2)$$

in which, a symbol of an element in the Formulas represents the content by mass percent of the element.

(2) The austenitic heat resistant alloy according to claim 1, wherein the alloy contains, by mass percent, at least one selected from a first group and/or a second group in place of a part of Fe.

First group: Ca: 0.02% or less, Mg: 0.02% or less, La: 0.1% or less, and Ce: 0.1% or less Second group: Ta: 0.1% or less, Hf: 0.1% or less, and Zr: 0.1% or less The "impurities" in "Fe and impurities" of the balance are elements that mixedly enter by means of various factors in the production process, including raw materials such as ore and scrap, when the heat resistant alloy is produced on an industrial scale.

Advantageous Effect(s) of the Invention

The austenitic heat resistant alloy in accordance with the present invention is excellent in both of weld crack resistance and toughness of HAZ, and is further excellent in creep strength at high temperatures. Therefore, the austenitic heat resistant alloy in accordance with the present invention can be used suitably as a starting material for high-temperature equipment such as power generation boilers and chemical industry plants.

BRIEF DESCRIPTION OF THE DRAWING(S)

FIG. 1 is an explanatory view showing the shape of beveling.

MODE FOR CARRYING OUT THE INVENTION

Hereunder, the reason why the content of component element in the austenitic heat resistant alloy in accordance with the present invention is restricted is explained in detail. In the explanation below, an ideogram of "%" relating to the content of each element means "mass percent".

C: 0.15% or less

Carbon (C) makes the austenitic structure stable and forms fine carbides at the grain boundaries, and therefore improves the creep strength at high temperatures. However, if the content thereof is excessive, the carbides become coarse, and precipitate in large amounts, which leads to a decrease in ductility of the grain boundaries and a degradation of the toughness and creep strength. Therefore, the C content is 0.15% or less. The upper limit of the C content is preferably 0.12%.

As described later, in the case where N is contained in the range sufficient for strengthening, the lower limit of the C content need not especially be defined. However, an extreme decrease in the C content leads to a remarkable rise in production cost. Therefore, the lower limit of the C content is preferably 0.01%.

Si: 2% or less

Silicon (Si) is an element that is added as a deoxidizer, and is effective in improving the corrosion resistance and oxidation resistance at high temperatures. However, if the content thereof is excessive, the stability of austenite phase deteriorates, which leads to a decrease in the toughness and creep strength. Therefore, the Si content is 2% or less. The Si content is preferably 1.5% or less, further preferably 1.0% or less. The lower limit of the Si content need not especially be defined. However, if the Si content is decreased extremely, the deoxidizing effect is not achieved sufficiently and the cleanliness of alloy is decreased, which leads to a rise in production cost. Therefore, the lower limit of the Si content is preferably 0.02%.

Mn: 3% or less

Manganese (Mn) is an element that is added as a deoxidizer, like Si, and contributes to the stabilization of austenite. However, if the content thereof is excessive, embrittlement occurs, and the toughness and creep ductility deteriorate. Therefore, the Mn content is 3% or less. The Mn content is preferably 2.5% or less, further preferably 2.0% or less. The lower limit of the Mn content also need not especially be defined. However, if the Mn content is decreased extremely, the deoxidizing effect is not achieved sufficiently and the cleanliness of alloy is decreased, which leads to a rise in production cost. Therefore, the lower limit of the Mn content is preferably 0.02%.

Ni: 40 to 60%

Nickel (Ni) is an element effective in obtaining an austenitic structure, and also an element essential in ensuring the structural stability after long-term use. Further, Ni combines with Al, Ti and Nb to form a fine intermetallic compound phase, and has an action for enhancing the creep strength. In order to achieve the effect of Ni sufficiently in the Cr content range of 15% or more and less than 28% defined in the present invention, 40% or more of Ni content is needed. However, since Ni is an expensive element, the containing of Ni exceeding 60% leads to a rise in cost. Therefore, the Ni content is 40 to 60%. The lower limit of the Ni content is preferably 42%, and the upper limit thereof is preferably 58%.

Co: 0.03 to 25%

Cobalt (Co) is, like Ni, an austenite producing element, and enhances the stability of austenite phase and contributes to the improvement in creep strength. To achieve this effect, the Co content must be 0.03% or more. However, since Co is an extremely expensive element, the containing of Co exceeding 25% leads to a significant rise in cost. Therefore, the Co content is 0.03 to 25%. The lower limit of the Co content is preferably 0.1%, further preferably 8%, and the upper limit thereof is preferably 23%.

Cr: 15% or more and less than 28%

Chromium (Cr) is an element essential in ensuring the oxidation resistance and corrosion resistance at high temperatures. In order to achieve the effect of Cr in the Ni content range of 40 to 60% defined in the present invention, 15% or more of Cr content is needed. However, if the Cr content increases to 28% or more, the stability of austenite phase at high temperatures deteriorates, which leads to a decrease in creep strength. Therefore, the Cr content is 15% or more and less than 28%. The lower limit of the Cr content is preferably 17%, and the upper limit thereof is preferably 26%.

Also, Cr is an element that exerts an influence on the grain-boundary segregation behavior of P and B in HAZ during welding, and exerts an indirect influence on the increase in liquation cracking susceptibility of HAZ and the decrease in toughness of HAZ after long-term use. Therefore, as described later, parameter F2 represented by Formula (2) consisting of P, B and Cr must be 0.035 or less.

Mo and W; either one or both of Mo: 12% or less and W: less than 4%, the total content thereof being 0.1 to 12%

Tungsten (W) and Molybdenum (Mo) are elements that dissolve in the austenitic structure, which is a matrix, and contribute to the improvement in creep strength at high temperatures. In order to achieve this effect, either one or both of Mo and W must be contained so that the total content thereof is 0.1% or more. However, if the total content of Mo and W becomes excessive and especially exceeds 12%, the stability of austenite phase is inversely deteriorated, which leads to a decrease in creep strength. Since W has an atomic weight larger than that of Mo, in order to achieve an effect equivalent to the effect of Mo, an increased amount of W must be contained. This is disadvantage from the viewpoint of cost and ensuring of phase stability. Therefore, the content of W, if contained, is less than 4%. Therefore, the contents of Mo and W are made such as to be either one or both of Mo: 12% or less and W: less than 4%, the total content thereof being 0.1 to 12%. The lower limit of the total content of W and Mo is preferably 1%, and the upper limit thereof is preferably 10%.

W and Mo need not be contained compositely. In the case where Mo is contained singly, the content thereof has only to be 0.1 to 12%. On the other hand, in the case where W is contained singly, the content thereof has only to be 0.1 or more and less than 4%. The upper limit of Mo contained singly is preferably 10%.

Nd: 0.001 to 0.1%

Neodymium (Nd) is an important element that characterizes the present invention. That is, Nd has a strong affinity for P and a fusing point thereof is high to form a stable compound with P to high temperatures. Therefore, Nd is an element essential in immobilizing P and eliminating the adverse influence of P on the liquation cracking and toughness of HAZ. Also, Nd is an element that precipitates as a carbide, and contributes to the improvement in high-temperature strength. In order to achieve these effects, 0.001% or more of Nd content is needed. However, if the Nd content becomes excessive and especially exceeds 0.1%, the effect of reducing the adverse influence of P saturates, and additionally, a large amount of Nd precipitates as carbide, which rather leads to a decrease in toughness. Therefore, the Nd content is 0.001 to 0.1%. The lower limit of the Nd content is preferably 0.005%, and the upper limit thereof is preferably 0.08%.

B: 0.0005 to 0.006%

Boron (B) is an element necessary for improving the creep strength by strengthening the grain boundaries by segregating at the grain boundaries during the use and by finely dispersing carbide at grain boundaries. In addition, B has effects of improving the sticking force by segregating at the grain boundaries and of contributing to the improvement in toughness. In order to achieve these effects, 0.0005% or more of B content is needed. However, if the B content increases and especially exceeds 0.006%, B is segregated in large amounts in the high-temperature HAZ in the vicinity of fusion boundary by the welding heat cycle during welding, and decreases the fusing point of grain boundary together with P, so that the liquation cracking susceptibility of HAZ is enhanced. Therefore, the B content is 0.0005 to 0.006%.

The segregation behavior of B is affected by the Cr content. Therefore, as described later, parameter F2 represented by Formula (2) consisting of P, B and Cr must be 0.035 or less.

N: 0.03% or less

Nitrogen (N) is an element effective in stabilizing the austenite phase. However, in the Cr content range of 15% or more and less than 28% defined in the present invention, if N is contained excessively, large amounts of fine nitrides are precipitated in the grains at high temperatures, which leads to a decrease in the creep ductility and toughness. Therefore, the N content is 0.03% or less. The N content is preferably 0.02% or less. The lower limit of the N content need not especially be defined. However, an extreme decrease in the N content leads to a rise in production cost. Therefore, the lower limit of the N content is preferably 0.0005%.

O: 0.03% or less

Oxygen (O) is contained in the alloy as one of impurity elements. If O is contained excessively, the hot workability is decreased, and the toughness and ductility are deteriorated. Therefore, the O content must be 0.03% or less. The O content is preferably 0.02% or less. The lower limit of the O content need not especially be defined. However, an extreme decrease in the O content leads to a rise in production cost. Therefore, the lower limit of the O content is preferably 0.001%.

Al, Ti and Nb; one or more kinds of Al: 3% or less, Ti: 3% or less, and Nb: 3% or less Aluminum (Al), titanium (Ti), and niobium (Nb) are elements essential in ensuring the creep strength at high temperatures by combining with Ni and by precipitating finely in the grains as intermetallic compounds. However, if the contents thereof increase and the content of each element exceeds 3%, the above-described effect saturates, and also the creep ductility and the toughness after long-term heating are deteriorated. Therefore, the content of each of Al, Ti and Nb is 3% or less, and one or more kinds of these elements are contained. The content of each of these elements is preferably 2.8% or less, further preferably 2.5% or less.

In order to ensure both of excellent creep strength and creep ductility by precipitating a proper amount of intermetallic compound, as described later, parameter F1 represented by Formula (1) consisting of Al, Ti and Nb must be 1 or more and 12 or less.

In the present invention, the contents of P and S in the impurities must be restricted so as to be in the following ranges.

P: 0.03% or less

Phosphorus (P) is contained in the alloy as an impurity. P is an element that segregates at the crystal grain boundaries of HAZ during welding, enhances the liquation cracking susceptibility, and exerts an adverse influence on the toughness after long-term use, too. Therefore, the P content is preferably decreased as far as possible. However, an extreme decrease in the P content leads to a rise in steel production cost. Therefore, the P content is 0.03% or less. The P content is preferably 0.02% or less.

S: 0.01% or less

Sulfur (S) is contained in the alloy as an impurity. S is an element that segregates at the crystal grain boundaries of HAZ during welding, enhances the liquation cracking susceptibility, and exerts an adverse influence on the toughness after long-term use, too. Therefore, the S content is preferably decreased as far as possible. However, an extreme decrease in the S content leads to a rise in steel production cost. Therefore, the S content is 0.01% or less. The S content is preferably 0.005% or less.

F1: 1 or more and 12 or less

In the case where in addition to the containing of the above-described amounts of one or more kinds of elements of Al, Ti and Nb, F1 represented by Formula (1), that is, [4×Al+2×Ti+Nb] is 1 or more and 12 or less, by precipitating the intermetallic compounds combined with Ni finely in the grains, the excellent creep strength at high temperatures and the excellent toughness after long-term heating can be ensured. The lower limit of F1 is preferably 3, and the upper limit thereof is preferably 11.

F2: 0.035 or less

As described already, P and B are elements that are segregated in the grain boundaries of HAZ in the vicinity of the fusion boundary by the heat cycle during welding, and decrease the fusing point and enhance the liquation cracking susceptibility of HAZ. On the other hand, during long-term use, P segregating at the grain boundaries decreases the sticking force of the grain boundaries, whereas B strengthens the grain boundaries inversely, so that P exerts an adverse influence on the toughness, and B inversely reduces the decrease in toughness. Further, Cr is an element that exerts an influence on the grain-boundary segregation behaviors of P and B and exerts an indirect influence on the performances of these elements.

That is, the degree of adverse influence of B on the liquation cracking of HAZ becomes greater with increasing Cr content. Also, the toughness of HAZ after long-term use is adversely affected by P greatly. In the case where approximately equal amounts of P and B are contained, as the Cr content decreases, the decrease in toughness tends to be larger.

In order to control the grain-boundary segregation of P and B in HAZ, and to ensure the excellent liquation cracking resistance and reduce the decrease in toughness after long-term heating, it is necessary that the above-described amount of Nd be contained as an essential element, and also F2 represented by Formula (2), that is, [P+0.2×Cr×B] be 0.035 or less. The upper limit of F2 is preferably 0.030. The lower limit of F2 may be a value close to 0.0015, which is the value in the case where the content of P as an impurity is extremely low, and the contents of Cr and B are 15% and 0.0005%, respectively.

One of the austenitic heat resistant alloys in accordance with the present invention is an alloy that contains elements from C to O in the above-described range, contains one or more kinds of elements of Al, Ti and Nb in the above-described range, the balance being Fe and impurities, and the contents of P and S in the impurities being in the above-described range, and parameters F1 and F2 represented by Formulas (1) and (2) are 1 or more and 12 or less and 0.035 or less, respectively.

The austenitic heat resistant alloy in accordance with the present invention can further selectively contain, as necessary, one or more kinds of elements belonging to the following groups in place of some of Fe.

First group: Ca: 0.02% or less, Mg: 0.02% or less, La: 0.1% or less, and Ce: 0.1% or less Second group: Ta: 0.1% or less, Hf: 0.1% or less, and Zr: 0.1% or less That is, one or more kinds of elements belonging to the first group and/or the second group may be added and contained as optional elements.

Hereunder, the operational advantages of these optional elements and the reasons why the contents thereof are restricted are explained.

First group: Ca: 0.02% or less, Mg: 0.02% or less, La: 0.1% or less, and Ce: 0.1% or less Ca, Mg, La and Ce, which are elements belonging to the first group, have an action for enhancing the hot workability. Further, these elements have an action for restraining the liquation cracking of HAZ caused by S and reducing the decrease in toughness. Therefore, to achieve these effects, the above-described elements may be added and contained. Hereunder, the elements of the first group are explained in detail.

Ca: 0.02% or less

Calcium (Ca) has a strong affinity for S, and has an action for enhancing the hot workability. Also, Ca has an effect of reducing both of the occurrence of liquation cracking of HAZ and the decrease in toughness, which are caused by S. However, if Ca is added excessively, the decrease in cleanliness caused by the combination with oxygen occurs, and especially if the Ca content exceeds 0.02%, the cleanliness decreases remarkably, and the hot workability is rather deteriorated. Therefore, the content of Ca, if contained, is 0.02% or less. The content of Ca, if contained, is preferably 0.01% or less.

On the other hand, in order to achieve the above-described effect of Ca stably, the lower limit of the content of Ca, if contained, is preferably 0.0001%, further preferably 0.0005%.

Mg: 0.02% or less

Magnesium (Mg) also has a strong affinity for S, and has an action for enhancing the hot workability. Also, Mg has an action for reducing both of the occurrence of liquation cracking of HAZ and the decrease in toughness, which are caused by S. However, if Mg is added excessively, the decrease in cleanliness caused by the combination with oxygen occurs, and especially if the Mg content exceeds 0.02%, the cleanliness decreases remarkably, and the hot workability is rather deteriorated. Therefore, the content of Mg, if contained, is 0.02% or less. The content of Mg, if contained, is preferably 0.01% or less.

On the other hand, in order to achieve the above-described effect of Mg stably, the lower limit of the content of Mg, if contained, is preferably 0.0001%, further preferably 0.0005%.

La: 0.1% or less

Lanthanum (La) has a strong affinity for S, and has an action for enhancing the hot workability. Also, La has an action for reducing both of the occurrence of liquation cracking of HAZ and the decrease in toughness, which are caused by S. However, if La is added excessively, the decrease in cleanliness caused by the combination with oxygen occurs, and especially if the La content exceeds 0.1%, the cleanliness decreases remarkably, and the hot workability is rather deteriorated. Therefore, the content of La, if contained, is 0.1% or less. The content of La, if contained, is preferably 0.08% or less.

On the other hand, in order to achieve the above-described effect of La stably, the lower limit of the content of La, if contained, is preferably 0.001%, further preferably 0.005%.

Ce: 0.1% or less

Cerium (Ce) has a strong affinity for S, and has an action for enhancing the hot workability. Also, Ce has an action for reducing both of the occurrence of liquation cracking of HAZ and the decrease in toughness, which are caused by S. However, if Ce is added excessively, the decrease in cleanliness caused by the combination with oxygen occurs, and especially if the Ce content exceeds 0.1%, the cleanliness decreases remarkably, and the hot workability is rather deteriorated. Therefore, the content of Ce, if contained, is 0.1% or less. The content of Ce, if contained, is preferably 0.08% or less.

On the other hand, in order to achieve the above-described effect of Ce stably, the lower limit of the content of Ce, if contained, is preferably 0.001%, further preferably 0.005%.

The above-described elements of Ca, Mg, La and Ce can be contained in one kind only or compositely in two or more kinds. The total amount of these elements, if contained, may be 0.24%, but is preferably 0.15% or less.

Second group: Ta: 0.1% or less, Hf: 0.1% or less, and Zr: 0.1 or less

Ta, Hf and Zr, which are elements belonging to the second group, have an action for enhancing the high-temperature strength. Therefore, to achieve this effect, the above-described elements may be added and contained. Hereunder, the elements of the second group are explained in detail.

Ta: 0.1% or less

Tantalum (Ta) dissolves in the matrix, or precipitates as carbide, and has an action for enhancing the strength at high temperatures. However, if the Ta content increases and exceeds 0.1%, carbides precipitate in large amounts, which leads to a decrease in toughness. Therefore, the content of Ta, if contained, is 0.1% or less. The content of Ta, if contained, is preferably 0.08% or less.

On the other hand, in order to achieve the above-described effect of Ta stably, the lower limit of the content of Ta, if contained, is preferably 0.002%, further preferably 0.005%.

Hf: 0.1% or less

Hafnium (Hf) also dissolves in the matrix, or precipitates as carbide, and has an action for enhancing the strength at high temperatures. However, if the Hf content increases and exceeds 0.1%, carbides precipitate in large amounts, which leads to a decrease in toughness. Therefore, the content of Hf, if contained, is 0.1% or less. The content of Hf, if contained, is preferably 0.08% or less.

On the other hand, in order to achieve the above-described effect of Hf stably, the lower limit of the content of Hf, if contained, is preferably 0.002%, further preferably 0.005%.

Zr: 0.1% or less

Zirconium (Zr) precipitates as carbide, and has an action for enhancing the strength at high temperatures. However, if the Zr content increases and exceeds 0.1%, carbides precipitate in large amounts, which leads to a decrease in toughness and an increase in liquation cracking susceptibility during welding. Therefore, the content of Zr, if contained, is 0.1% or less. The content of Zr, if contained, is preferably 0.08% or less.

On the other hand, in order to achieve the above-described effect of Zr stably, the lower limit of the content of Zr, if contained, is preferably 0.002%, further preferably 0.005%.

The above-described elements of Ta, Hf and Zr can be contained in one kind only or compositely in two or more kinds. The total amount of these elements, if contained, may be 0.3%, but is preferably 0.15% or less.

Hereunder, the present invention is explained more specifically based on examples. The present invention is not limited to these examples.

EXAMPLE(S)

Austenitic alloys A1 to A11 and B1 to B8 having chemical compositions given in Table 1 were melted, hot forged, hot rolled, and subjected to heat treatment and machining to prepare plate materials each having a plate thickness of 20 mm, a width of 50 mm, and a length of 100 mm.

Alloys A1 to A11 in Table 1 are alloys each having a chemical composition in the range defined in the present invention. On the other hand, alloys B1 to B8 are alloys each having a chemical composition deviating from the condition defined in the present invention.

TABLE 1

| | Chemical composition (% by mass) Balance: Fe and impurities | | | | | | | | | | | |
|---|---|---|---|---|---|---|---|---|---|---|---|---|
| Alloy | C | Si | Mn | P | S | Ni | Co | Cr | Mo | W | Mo + W | Nd |
| A1 | 0.059 | 0.12 | 0.07 | 0.015 | 0.001 | 53.88 | 9.99 | 21.97 | 5.42 | 3.80 | 9.22 | 0.006 |
| A2 | 0.060 | 0.11 | 0.06 | 0.012 | 0.001 | 56.63 | 10.14 | 22.21 | 8.46 | — | 8.46 | 0.006 |
| A3 | 0.056 | 0.11 | 0.07 | 0.008 | 0.001 | 54.37 | 10.08 | 22.25 | 5.49 | 3.52 | 9.01 | 0.007 |
| A4 | 0.030 | 0.49 | 0.30 | 0.013 | 0.001 | 48.31 | 20.09 | 24.92 | 0.51 | 0.02 | 0.53 | 0.020 |
| A5 | 0.059 | 0.21 | 0.30 | 0.012 | 0.001 | 50.89 | 20.14 | 19.75 | 5.58 | 0.02 | 5.60 | 0.025 |
| A6 | 0.081 | 0.48 | 0.50 | 0.014 | 0.001 | 52.57 | 12.49 | 21.83 | 9.00 | 0.03 | 9.03 | 0.026 |
| A7 | 0.060 | 0.12 | 0.06 | 0.001 | 0.001 | 54.01 | 10.10 | 22.11 | 5.52 | 3.90 | 9.42 | 0.006 |
| A8 | 0.078 | 0.43 | 0.46 | 0.012 | 0.001 | 52.45 | 12.20 | 22.05 | 11.78 | 0.05 | 11.83 | 0.019 |
| A9 | 0.061 | 0.15 | 0.08 | 0.013 | 0.001 | 54.25 | 8.02 | 22.24 | 4.89 | 3.68 | 8.57 | 0.020 |
| A10 | 0.062 | 0.12 | 0.05 | 0.013 | 0.001 | 55.53 | 10.05 | 22.36 | — | 3.92 | 3.92 | 0.016 |
| A11 | 0.060 | 0.15 | 0.07 | 0.015 | 0.001 | 53.92 | 9.98 | 22.51 | 5.20 | 3.65 | 8.85 | 0.020 |
| B1 | 0.059 | 0.12 | 0.10 | 0.016 | 0.001 | 52.57 | 9.79 | 21.98 | 4.92 | 3.85 | 4.92 | * — |
| B2 | 0.080 | 0.50 | 0.50 | 0.012 | 0.001 | 52.43 | 12.69 | 21.85 | 8.98 | 0.12 | 9.10 | 0.004 |
| B3 | 0.062 | 0.20 | 0.30 | 0.015 | 0.001 | 50.74 | 19.95 | 19.74 | 5.50 | 0.10 | 5.60 | * — |
| B4 | 0.056 | 0.11 | 0.06 | 0.010 | 0.001 | 54.07 | 9.90 | 22.05 | 5.42 | 3.41 | 8.83 | 0.006 |

TABLE 1-continued

| | | | | | | | | | | | | |
|---|---|---|---|---|---|---|---|---|---|---|---|---|
| B5 | 0.032 | 0.50 | 0.30 | 0.012 | 0.001 | 48.38 | 20.23 | 25.05 | 0.51 | 0.15 | 0.66 | 0.005 |
| B6 | 0.076 | 0.46 | 0.51 | 0.014 | 0.001 | 52.55 | 11.89 | 22.26 | 9.25 | 0.20 | 9.45 | * — |
| B7 | 0.080 | 0.50 | 0.50 | 0.012 | 0.001 | 52.43 | 12.69 | 21.85 | 8.98 | 0.12 | 9.10 | * — |
| B8 | 0.060 | 0.15 | 0.08 | 0.015 | 0.001 | 53.65 | 10.12 | 22.41 | 5.60 | 3.75 | 9.35 | 0.012 |

| | Chemical composition (% by mass) Balance: Fe and impurities | | | | | | | | |
|---|---|---|---|---|---|---|---|---|---|
| Alloy | B | Al | Ti | Nb | N | O | Others | F1 | F2 |
| A1 | 0.0012 | 1.01 | 1.60 | — | 0.008 | 0.003 | — | 7.24 | 0.020 |
| A2 | 0.0026 | 1.36 | 1.37 | — | 0.008 | 0.004 | — | 8.18 | 0.024 |
| A3 | 0.0015 | 1.02 | 1.64 | 0.01 | 0.007 | 0.003 | Hf: 0.005, Ca: 0.002 | 7.37 | 0.015 |
| A4 | 0.0005 | 0.91 | 1.81 | 1.97 | 0.006 | 0.003 | — | 9.23 | 0.015 |
| A5 | 0.0033 | 0.52 | 2.22 | 0.01 | 0.004 | 0.002 | — | 6.53 | 0.025 |
| A6 | 0.0036 | 1.19 | 0.31 | 0.01 | 0.005 | 0.002 | — | 5.39 | 0.030 |
| A7 | 0.0028 | — | 2.09 | — | 0.004 | 0.003 | — | 4.18 | 0.013 |
| A8 | 0.0010 | 1.09 | 0.29 | — | 0.004 | 0.002 | Ce: 0.005 | 4.94 | 0.016 |
| A9 | 0.0008 | 1.30 | 1.36 | — | 0.006 | 0.002 | Zr: 0.003 | 7.92 | 0.017 |
| A10 | 0.0010 | 1.50 | 1.41 | — | 0.006 | 0.004 | Mg: 0.002, La: 0.005 | 8.82 | 0.017 |
| A11 | 0.0023 | 2.11 | — | — | 0.005 | 0.004 | — | 8.44 | 0.025 |
| B1 | 0.0031 | 0.96 | 1.63 | 1.54 | 0.015 | 0.003 | — | 8.64 | 0.017 |
| B2 | 0.0060 | 1.19 | 0.31 | 0.01 | 0.005 | 0.002 | — | 5.39 | * 0.038 |
| B3 | 0.0052 | 0.51 | 2.22 | 0.01 | 0.008 | 0.003 | Mg: 0.001 | 6.49 | * 0.036 |
| B4 | * — | 1.31 | 1.33 | 0.02 | 0.007 | 0.003 | Ta: 0.002 | 7.92 | 0.010 |
| B5 | 0.0040 | 1.82 | 1.84 | 1.98 | 0.007 | 0.003 | — | * 12.94 | 0.032 |
| B6 | 0.0046 | 1.30 | 0.33 | 0.01 | 0.004 | 0.003 | La: 0.022 | 5.86 | 0.034 |
| B7 | * 0.0071 | 1.19 | 0.31 | 0.01 | 0.005 | 0.002 | La: 0.012, Ce: 0.009 | 5.38 | * 0.043 |
| B8 | 0.0025 | 0.05 | 0.05 | 0.62 | 0.005 | 0.004 | — | * 0.92 | 0.010 |

F1 = 4 × Al + 2 × Ti + Nb

F2 = P + 0.2 × Cr × B

The mark * indicates falling outside the conditions regulated by the present invention.

In the longitudinal direction of each of the above-described plate materials each having a plate thickness of 20 mm, a width of 50 mm, and a length of 100 mm, a bevel having a shape shown in FIG. 1 was formed, and root pass welding was performed by tungsten inert gas welding with the heat input being 9 kJ/cm by using a welding wire of AWS Standard A5.14 ERNiCrCoMo-1. Thereafter, the circumference of the plate material was restraint-welded onto an SM400C steel plate (JIS Standard G3106 (2008)) having a thickness of 25 mm, a width of 200 mm, and a length of 200 mm by using a covered electrode of JIS Standard Z3224 (2007) DNiCrFe-3.

Subsequently, multi-pass welding was performed in the bevel by tungsten inert gas welding with the heat input being 9 to 15 kJ/cm by using the same welding wire, whereby two joints were prepared per each test symbol. One joint of each test symbol was subjected to a test in an as-welded state, and the remaining joint was subjected to aging heat treatment of 700° C.×100 hours before the test.

Specifically, a transverse cross-section specimen was sampled from the as-welded joint, and the cross section was mirror polished and corroded. Thereafter, the corroded cross section was observed under an optical microscope to examine whether or not liquation cracking of HAZ is present.

Also, from the as-welded joint, a round-bar creep rupture test specimen was sampled so that the fusion boundary was located in the center of the parallel part, and a creep rupture test was conducted under the conditions of 700° C. and 176 MPa in which the target rupture time of the base material was 1000 hours or longer. The alloy in which the creep rupture time exceeded 1000 hours, which was the target rupture time of the base material, was made "acceptable".

In addition, from each of the as-welded joint and the welded joint having been subjected to aging heat treatment of 700° C.×100 hours after the welding work, a 5 mm-wide sub-size Charpy V-notch test specimen specified in JIS Z2242 (2005) in which a notch was formed at the fusion boundary was sampled, and the toughness was investigated by an impact test at 0° C. The alloy in which the decrease in absorbed energy did not exceed 50 J when the aging heat treatment was performed was made "acceptable".

Table 2 summarizes the results of the above-described tests. In the "Liquation cracking of HAZ" column in Table 2, mark "○" indicates that a crack was not noticed, and on the other hand, mark "x" indicates that a crack was noticed. Also, in the "Creep rupture test" column, mark "○" indicates "acceptable", that is, that the creep rupture time under the above-described conditions exceeded 1000 hours, which was the target rupture time of base material, and mark "x" indicates that the creep rupture time did not reach 1000 hours. Further, in the "toughness" column, mark "○" indicates "acceptable", that is, that the decrease in absorbed energy did not exceed 50 J when the aging heat treatment was performed, and mark "x" indicates that the decrease in absorbed energy exceeded 50 J.

TABLE 2

| Test mark | Alloy | Liquation cracking in the HAZ | Creep rupture test | Toughness | Note |
|---|---|---|---|---|---|
| 1 | A1 | ○ | ○ | ○ | Inventive |
| 2 | A2 | ○ | ○ | ○ | Example |
| 3 | A3 | ○ | ○ | ○ | |
| 4 | A4 | ○ | ○ | ○ | |
| 5 | A5 | ○ | ○ | ○ | |
| 6 | A6 | ○ | ○ | ○ | |
| 7 | A7 | ○ | ○ | ○ | |
| 8 | A8 | ○ | ○ | ○ | |
| 9 | A9 | ○ | ○ | ○ | |
| 10 | A10 | ○ | ○ | ○ | |
| 11 | A11 | ○ | ○ | ○ | |
| 12 | * B1 | x | ○ | x | Comparative |

TABLE 2-continued

| Test mark | Alloy | Liquation cracking in the HAZ | Creep rupture test | Toughness | Note |
|---|---|---|---|---|---|
| 13 | * B2 | x | ○ | x | Example |
| 14 | * B3 | x | ○ | x | |
| 15 | * B4 | ○ | x | ○ | |
| 16 | * B5 | ○ | ○ | x | |
| 17 | * B6 | x | ○ | x | |
| 18 | * B7 | x | ○ | x | |
| 19 | * B8 | ○ | x | ○ | |

The mark * indicates falling outside the conditions regulated by the present invention.
In the column of "Liquation cracking in the HAS" the symbols "○" and "x" indicate that "no cracking was observed" and "a cracking was observed" respectively.
In the column of "Creep rupture test" the symbols "○" and "x" indicate that "the rupture time achieved the aim" and "the rupture time did not achieve the aim" respectively.
In the column of "Toughness" each symbol "○" and "x" indicate that "the decrease in the absorbed energy did not exceed 50 J" and "the decrease in the absorbed energy exceeded 50 J" when an aging heat treatment was carried out.

From Table 2, it is apparent that, for test symbols 1 to 11 using alloys A1 to A11 having a chemical composition in the range defined in the present invention, the liquation cracking of HAZ is not noticed, and moreover the creep rupture characteristics and the toughness after long-term heating are excellent.

In contrast, for test symbols 12 to 19 using alloys B1 to B8 having a chemical composition deviating from the condition defined in the present invention, at least any of the liquation cracking of HAZ, the creep rupture characteristics, and the toughness after long-term heating is inferior.

For test symbol 12 using alloy B1 that did not contain Nd, since the effect of eliminating the adverse influence of P on the liquation cracking and toughness of HAZ could not be achieved, the liquation cracking of HAZ occurred, and also the toughness decreased after long-term heating.

For test symbol 13, although alloy B2 used contained Nd, F2 defined by P, B and Cr exceeded 0.035. Therefore, the liquation cracking of HAZ occurred, and also the toughness decreased after long-term heating.

For test symbol 14, alloy B3 used did not contain Nd, and additionally F2 defined by P, B and Cr exceeded 0.035. Therefore, the liquation cracking of HAZ occurred, and also the toughness decreased remarkably after long-term heating.

For test symbol 15, since alloy B4 used contained Nd, and further F2 defined by P, B and Cr met the condition defined in the present invention, the liquation cracking of HAZ did not occur. However, since alloy B4 did not contain B, a sufficient creep strength was not obtained.

For test symbol 16, since alloy B5 used met the conditions of the contents of Nd, P, B and Cr and F2, defined in the present invention, the Equation cracking of HAZ did not occur. However, since F1 of alloy B5 defined by Al, Ti and Nb exceeded 12, the toughness decreased remarkably after long-term heating.

For test symbols 17 and 18, although alloys B6 and B7 used contained La and/or Ce, which are generally referred to as REM, the alloys did not contain Nd. Therefore, the effect of eliminating the adverse influence of P on the liquation cracking and toughness of HAZ could not be achieved, so that the liquation cracking of HAZ occurred, and also the toughness decreased after long-term heating.

For test symbol 19, since alloy B8 used met the conditions of the contents of Nd, P, B and Cr and F2, defined in the present invention, the liquation cracking of HAZ did not occur. However, since F1 of alloy B8 defined by Al, Ti and Nb was less than 1, a sufficient creep strength was not obtained.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The austenitic heat resistant alloy in accordance with the present invention is excellent in both of weld crack resistance and toughness of HAZ, and is further excellent in creep strength at high temperatures. Therefore, the austenitic heat resistant alloy in accordance with the present invention can be used suitably as a starting material for high-temperature equipment such as power generation boilers and chemical industry plants.

What is claimed is:

1. An austenitic heat resistant alloy consisting of, by mass percent, C: 0.15% or less, Si: 2% or less, Mn: 3% or less, Ni: 40 to 60%, Co: 10.14 to 25%, Cr: 15% or more and less than 28%, either one or both of Mo: 12% or less and W: less than 0.05%, the total content thereof being 0.1 to 12%, Nd: 0.001 to 0.1%, B: 0.0005 to 0.006%, N: 0.03% or less, O: 0.03% or less, at least one selected from Al: 1.36% or less, Ti: 3% or less, and Nb: 3% or less, the balance being Fe and impurities, and the contents of P and S in the impurities being P: 0.03% or less and S: 0.01% or less, wherein parameter F1 represented by Formula (1) is 1 or more and 12 or less, and parameter F2 represented by Formula (2) is 0.035 or less, $$F1=4\times Al+2\times Ti+Nb \quad (1)$$

$$F2=P+0.2\times Cr\times B \quad (2)$$

in which, a symbol of an element in the Formulas represents the content by mass percent of the element.

2. An austenitic heat resistant alloy consisting of, by mass percent, C: 0.15% or less, Si: 2% or less, Mn: 3% or less, Ni: 40 to 60%, Co: 10.14 to 25%, Cr: 15% or more and less than 28%, either one or both of Mo: 12% or less and W: less than 0.05%, the total content thereof being 0.1 to 12%, Nd: 0.001 to 0.1%, B: 0.0005 to 0.006%, N: 0.03% or less, O: 0.03% or less, at least one selected from Al: 1.36% or less, Ti: 3% or less, and Nb: 3% or less, and at least one selected from a first group and/or a second group, the balance being Fe and impurities, and the contents of P and S in the impurities being P: 0.03% or less and S: 0.01% or less, wherein parameter F1 represented by Formula (1) is 1 or more and 12 or less, and parameter F2 represented by Formula (2) is 0.035 or less, and for the first group: Ca: 0.02% or less, Mg: 0.02% or less, La: 0.1% or less, and Ce: 0.1% or less, and for the second group: Ta: 0.1% or less, Hf: 0.1% or less, and Zr: 0.1% or less, and $$F1=4\times Al+2\times Ti+Nb \quad (1)$$

$$F2=P+0.2\times Cr\times B \quad (2)$$

in which, a symbol of an element in the Formulas represents the content by mass percent of the element.

* * * * *